United States Patent [19]

Gierek et al.

[11] 4,148,942

[45] Apr. 10, 1979

[54] REMOVAL OF EXCESS MOLTEN ALUMINUM OR ITS ALLOYS FROM ARTICLES COATED BY THE HOT-DIP METHOD

[75] Inventors: Adam Gierek; Lech Bajka, both of Katowice; Jan Kolpak, Myslowice, all of Poland

[73] Assignee: Politechmika Slaska Im. Wincentego Pstrowskiego, Gliwice, Poland

[21] Appl. No.: 818,020

[22] Filed: Jul. 21, 1977

Related U.S. Application Data

[63] Continuation-in-part of Ser. No. 649,514, Jan. 15, 1976, abandoned.

[30] Foreign Application Priority Data

Jan. 18, 1975 [PL] Poland ..... 177420

[51] Int. Cl.[2] ..... C23C 1/08

[52] U.S. Cl. ..... 427/241; 427/347; 427/431; 118/52; 118/54

[58] Field of Search ..... 427/241, 347, 431; 118/52, 53, 54

[56] References Cited

U.S. PATENT DOCUMENTS

| | | | |
|---|---|---|---|
| 1,713,233 | 5/1929 | Kelley | 427/241 |
| 1,796,820 | 3/1931 | Adams | 118/54 |
| 2,273,250 | 2/1942 | Charlton | 427/241 |
| 2,885,304 | 5/1959 | Thomson et al. | 427/347 X |
| 2,917,818 | 12/1959 | Thomson | 427/347 |
| 3,753,762 | 8/1973 | Garrison | 427/347 |
| 3,806,356 | 4/1974 | Shoemaker | 427/431 |

*Primary Examiner*—Ralph S. Kendall

*Attorney, Agent, or Firm*—Haseltine, Lake, & Waters

[57] ABSTRACT

A process for removing excess molten aluminum or its alloys from articles following the aluminizing of same in such melt by high speed revolution of said articles while withdrawing from said melt.

8 Claims, No Drawings

REMOVAL OF EXCESS MOLTEN ALUMINUM OR ITS ALLOYS FROM ARTICLES COATED BY THE HOT-DIP METHOD

CROSS REFERENCE TO RELATED APPLICATION

This application is a continuation-in-part of Ser. No. 649,514, filed Jan. 15, 1976, now abandoned.

BACKGROUND OF THE INVENTION

This invention relates to the removal of excess molten aluminum and molten aluminum alloys from metal articles aluminized by the hot-dip method.

The aluminum coating produced by the hot-dip method consists of two layers: an outer layer and a transitional layer. The outer layer, which contains areas of almost pure aluminum has a decisive influence upon the corrosion properties of the coatings, especially in oxidizing environments, both in ambient and high temperatures, caused by the formation of a thin $Al_2O_3$ layer on the coating surface.

The outer layer is formed of an $FeAl_3$ phase in the form of columnar crystallites which are its frame during the aluminizing process. The free spaces between the crystallites are filled with an aluminum rich composition comprising 98% Al/eutectic composition (Al and $FeAl_3$).

The transitional (intermetallic) layer is characterized by particular corrosion resistance in brines and in lyes and in some acid solutions. Mainly, that layer consists of two zones, which beginning from the surface create: a thin layer of minute $FeAl_3$ crystals and a considerably thicker layer of directionally growing columnar cristallites $Fe_2Al_5$ phase whose cross section is visible as "teeth" penetrating into the substrate.

The thickness of the outer aluminum layer is most important for preserving the primary shape of the original product. Complex shaped elements, such as for example, fine pitch threads when removed from the aluminum coating bath are frequently considerably distorted with the grooves or indentations all filled in with a molten outer layer of aluminum.

In the methods of the prior art, the removal of the liquid outer layer is accomplished by reducing the viscosity of the molten aluminum or aluminum alloys. This is obtained either by increasing the temperature of the molten bath or alloying with metals, such as lithium, sodium, or beryllium. Employing low speeds when the article is withdrawn from the molten bath is also significant in removal of excess molten aluminum.

One of the well known methods for the removal of excess aluminum and its alloys from the surfaces of compact shaped elements, such as white malleable cast iron bodies consists in withdrawing such a product from the molten bath at a linear speed of 0.5 m per minute from a bath containing 4% silicon at a temperature of 750° C. and subsequently slowly cooling the products in the atmosphere.

These known methods for removal of excess molten aluminum and its alloys from the surface of aluminum coated articles have many disadvantages since they are deficient in removing excess aluminum and its alloys from complex shaped articles particularly from the grooves and holes of threaded elements.

Accordingly the traditional hot-dip method for coating aluminum can be employed only for such types of simply shaped articles as wire or steel tape and elements of compact shape having no incisions, holes or indentations. Such articles are most often simply shaped castings and forgings.

The traditional hot-dip method cannot be used for aluminum coating of detailed articles or those of a small size which previously have been finished by machining, abrading or filing to an exact shape, dimension or close tolerances, as is the case with finely threaded elements. Excessive aluminum or its alloys on the surface of coated articles form the shape of icicles and drops which clearly deform the coated article and consume excess quantities of aluminum and its alloys, thus increasing the cost of the process. Finally, the excess aluminum on the surface of the coated articles makes for an uneven coating layer.

In view of the fact that the thickness of the outer layer depends largely on the bath temperatures and the immersion time, simultaneous thermal treatment and coating of the articles with aluminum can be very difficult, or even impossible, because during longer heat treatment of articles immersed in an aluminum bath, for example 25 minutes, the outer layer would be so thick that it would distort the original shape of the article. Additionally, the high-temperature bath increases the cost of the process. The efficiency is also limited by the low speeds of withdrawal from the bath used in the known method.

The novel method of this invention obviates these disadvantages with its procedure detailed in the following.

SUMMARY OF THE INVENTION

More particularly, this invention deals with a method for removing excess molten aluminum or its alloys from articles, especially complex shaped elements, coated by the hot-dip method in a molten bath of aluminum or its alloys wherein following the immersion of said articles they are rotated during withdrawal from the bath at a speed of 10 to 750 r.p.m., while being withdrawn from said bath at a linear rate of 0.1 to 12 meters per minute, and at a speed of 10 to 1500 r.p.m. above the surface of the bath. The articles are placed on hangars or into perforated or openwork baskets when immersed for coating in the molten aluminum or aluminum alloy bath. The baskets containing the articles are rotated during withdrawal from the molten bath, through the liquid metal-atmosphere boundary and above the surface of the bath.

The purpose of this invention is to obtain an aluminum or aluminum alloy coated metal article wherein the coating consistency is such as not to deform or misshape in any manner the fine details and complex shape of such metal article.

A further purpose of this invention is to provide a method for coating to obtain an aluminum or aluminum alloy coated article which is not deformed or misshaped in any manner by virtue of such coating.

Other purposes and advantages will be immediately apparent from the description of the invention and the Examples recited hereinbelow.

DETAILED DESCRIPTION OF THE INVENTION

The rotation of the articles after dipping in the aluminizing bath occurs during and after withdrawal from the bath but always within the aluminizing furnace.

The speed of rotation ranges from 10 to 1500 r.p.m. and the rate of withdrawal from the bath ranges from 0.1 to 12 m per minute. The rotation can be in one or both directions. The rotation and the withdrawal can be continuous or stepwise.

The speed of rotation and rate of withdrawal will depend on the preassumed structure and chemical composition of the coating layer. The values of speeds of rotation and rate of withdrawal from the bath are chosen on the basis of the bath temperature and its chemical composition, time of immersion in the baths, as well as the shape, weight and construction of the articles to be coated. The dimensions and shapes of the hangers and perforated baskets are also important in determining the quality of the resulting coating. The preferred basket has a diameter of from 300 to 700 mm with walls of honeycombed structure having holes not smaller than 40×40 mm. It is provided with two propellers. One, attached to the lower outer surface of the basket, removes aluminum oxide from the surface of the bath—before immersion. The other, attached to the top of the basket, removes aluminum oxide and intermetallics such as $FeAl_3$ or $Fe_2Al_5$ from the bath before withdrawal of the basket. The preferred aluminum alloy for the purposes of the invention contains from 3 to 8% Si, from 0.5 to 5% Fe, from 0.5 to 5% Pb and from 0.1 to 3% Sn. The temperature of the bath is in the range from 730 to 770° C.

Rotating the articles to remove excess quantities of liquid metal from the surfaces of such products is of importance not only to preserve the original shape of the articles, including fine threaded details, but also for the thickness and structure of the aluminum or alloy coating layer. Thus, by an appropriate speed of rotation, the quality of the coating layers, especially with respect to thickness, structure and chemical composition, can be controlled during the whole operation and determined to a very high degree.

The invention also assures evenness, continuity and uniformity of the coating on the surface of elements of fine or complex shape; it ensures coats with no excess aluminum or its alloys, thus decreasing the consumption of such coating metals. The method also makes possible coating of aluminum or its alloys with relatively low temperature molten aluminum or aluminum alloys thus additionally saving some power, while simultaneously heat treating said articles during molten bath immersion.

The speed of rotation of the article while being withdrawn through the molten bath and its surface ranges from 10–750 preferably 50–200 r.p.m., and from 10–1500, preferably 50–700 r.p.m. once such articles have cleared the surface of said bath.

In the process of the invention, the basket should preferably first be dipped into the metal bath before the articles are charged into it. Otherwise, blank spaces or black holes may occur in the coating on the articles where they have been in contact with the walls of the basket.

The following examples of treating metal articles by molten aluminum or its alloys are meant to be illustrative and are in no manner to be construed as limiting the invention.

EXAMPLE I

Steel screws with cold rolled threads are plunged into a molten coating bath of an alloy of 94% Al and 6% Si at a temperature of 750° C. in a previously dipped perforated basket not exceeding 500 mm in diameter. The basket remains in said bath until the coating of said screws is completed. The excess aluminum is then removed by rotating the products at a rate of about 50 r.p.m. during withdrawal from said bath and then speeding up said rate of rotation to about 700 r.p.m. for about 5 to 15 sec. once the basket is above bath level. The linear speed of withdrawal is about 10 m per minute. Following the high speed rotation treatment, the rate of withdrawal from the bath is reduced to zero. The aluminum or alloy coated screws are then transferred to a water-cooled container to bring them to ambient temperature. The temperature of cooled water must be kept in the range 60°–90° C.

EXAMPLE II

When the above procedure is followed using a bath of an aluminum alloy containing, beside aluminum, 3–8% Si, 0.5–5% Fe, 0.5–5% Pb, and 0.1–3% Sn, a bath temperature in the range of 730°–770° C. is used. The rate of revolution during withdrawal is 50 to 200 r.p.m. and from 50–700 r.p.m. above the bath.

While this invention has been described with particular reference to specific practice and example it will be understood by those skilled in the art that it is susceptible to changes and modifications without departing from the scope thereof as defined in the appended claims.

We claim:

1. A method for removing excess molten aluminum or its alloys from metal articles aluminized by the hot-dip molten, especially complex shaped elements, immersed in a bath of molten aluminum or an alloy thereof in an aluminizing furnace comprising the steps of:

withdrawing the articles from the molten bath and its surface with simultaneous rotation during the period of withdrawal at a rate within the range of 10–750 r.p.m., the rate of withdrawal being linear, concurrent with the rate of rotation, and having a range from about 0.1 to 12 meters per minute; and continuing rotating the articles after withdrawal from the bath at a rate within the range of 10 to 1500 r.p.m. until the excess molten aluminum has been removed, both of said rotating steps taking place in the aluminizing furnace.

2. The method according to claim 1 wherein a transitional layer and an outer layer are formed on the articles during immersion in the bath and the step of rotating the articles during and after withdrawal from the bath includes the step of controlling the thickness, structure and chemical composition of each of said layers, especially of said outer layer.

3. The method of claim 1 wherein the rate of rotation during withdrawal is from 50 to 200 r.p.m. and after withdrawal is from 50 to 700 r.p.m.

4. The method of claim 3 wherein the bath comprises a molten aluminum alloy consisting essentially of aluminum containing from 3 to 8% Si, from 0.5 to 5% Fe, from 0.5 to 5% Pb and from 0.1 to 3% Sn.

5. The method of claim 4 wherein the temperature of the bath is from 730 to 770° C.

6. The method of claim 1 wherein the articles before immersion in the bath are placed in a previously dipped basket having a diameter of 300 to 700 mm, walls of honeycombed structure having holes not smaller than 40×40 mm, and provided with a propeller attached to the lower, outer surface of the basket and a second propeller attached to the top of the basket.

7. The method of claim 1 wherein the articles after withdrawing from the bath are transferred to a water-cooled container, wherein cooled water temperature is in the range 60–90° C.

8. The method of claim 1 wherein the metal articles are iron articles and the rotation after withdrawal is carried out for a period of 5 to 15 seconds.

* * * * *